United States Patent [19]

Perciful

[11] Patent Number: 4,673,219

[45] Date of Patent: Jun. 16, 1987

[54] POWER DRIVEN ROOFING REMOVAL TOOL

[75] Inventor: David D. Perciful, Jonesboro, Ark.

[73] Assignees: J. T. Barr, Jonesboro; Keith Doty, Mountain Home, both of Ark.

[21] Appl. No.: 801,867

[22] Filed: Nov. 26, 1985

[51] Int. Cl.[4] ..... E04D 15/02

[52] U.S. Cl. ..... 299/39; 299/36

[58] Field of Search ..... 299/39, 37, 38, 40, 299/41; 180/19.1; 30/170; 51/174, 176

[56] References Cited

U.S. PATENT DOCUMENTS

| | | | |
|---|---|---|---|
| 852,583 | 5/1907 | Short | 30/170 |
| 1,162,061 | 11/1915 | Hill | 299/39 |
| 1,162,596 | 11/1915 | Foster et al. | 299/39 |
| 1,500,771 | 7/1924 | Schlueter | 51/176 |
| 1,504,594 | 8/1924 | Agar | 299/39 |
| 2,710,180 | 6/1955 | Graham | 299/38 |
| 3,389,504 | 6/1968 | Brodigan | 51/176 |
| 3,711,158 | 1/1973 | Butcher | 299/39 X |
| 3,740,099 | 6/1973 | Lenzer | 299/39 |
| 4,103,973 | 8/1978 | Cutler | 299/39 |
| 4,219,238 | 8/1980 | Sanchez | 299/39 |
| 4,269,450 | 5/1981 | Welborn | 299/39 |

*Primary Examiner*—Stephen J. Novosad

*Assistant Examiner*—Michael A. Goodwin

*Attorney, Agent, or Firm*—Stephen D. Carver

[57] ABSTRACT

A motor powered, drum equipped, manually operable shingle removal tool for use by roofing contractors, home improvement companies and the like. A rigid, steel frame mechanically supports a conventional internal combustion engine linked through appropriate belts and pulleys to a front-mounted rotary drum. A plurality of rigid cutting teeth disposed about the outer surface of the cylindrical drum are adapted to forcibly contact the shingles to be removed. A lower sled which guides the tool along the roof surface may be selectively adjusted to facilitate proper elevation of the rotary drum above the shingle surface at a suitable height for optimum operation. The cutting teeth of the drum may be adjustably positioned relative to the outer surface of the drum to compensate for adjustment of the sled. A selectively adjustable elongated handle coupled to the rear of the machine frame directly above a pair of caster wheels facilitate maneuvering of the tool. The handle may be pushed down to pivot the drum over the caster wheels, moving the revolving teeth out of contact with the roof. A safety kill switch associated with the handle stops the motor when released by the operator.

2 Claims, 7 Drawing Figures

POWER DRIVEN ROOFING REMOVAL TOOL

BACKGROUND OF THE INVENTION

The present invention relates generally to roofing removal and installation tools and equipment. More particularly, the present invention relates to motor powered tools for use on inclined or flat roofs of the type adapted to remove shingles, roofing or the like.

As will be readily appreciated by those skilled in the roofing arts, proper preparation of an existing roof for a replacement shingle installation is a difficult and time consuming job. Except where only small patches of the roof are to be repaired, the normal practice is to remove very large sections of the old shingles prior to installation of replacements. At present shingles are removed manually through a variety of conventional hand tools. Such tools are often cumbersome to operate, and their use results in a waste of precious man hours. The steep and often dangerous incline of conventional roofs further aggravates the problems encountered in removing shingles with conventional hand tools.

Therefore, it would seem desirable to provide a power driven roofing tool adapted to quickly remove shingles. Of course, such a machine must be relatively easily maneuvered by an operator, and it must function comfortably upon the steep incline of conventional roofs. Such a machine must be properly engineered so as to avoid or prevent injury to both the operator and his coworkers.

SUMMARY OF THE INVENTION

The present invention comprises a motor powered shingle removal tool ideal for use by roofing contractors, home improvement companies and the like.

In the best mode of the invention the tool comprises a rigid, steel frame which mechanically supports a conventional internal combustion engine. At the front of the frame a rotary drum is properly journalled, and through appropriate couplings the drum is forcibly driven by the internal combustion engine. A plurality of teeth disposed about the outer surface of the drum are adapted to be rotated thereby, and when properly disposed in physical contact with the shingles, the shingles will be rapidly destroyed and removed from the roof.

Preferably the tool includes a lower sled which skids along the roof in response to control of the machine by the user. This sled facilitates proper elevation of the rotary drum above the shingle surface to be attacked, and the sled may be adjusted in height so as to raise or lower the position of the drum. Thus, for example, as the teeth provided on the drum wear out, the drum may be lowered into more appropriate contact with the shingled surface. Moreover, when shingles of different thicknesses or types are encountered, the sled may also be adjusted to facilitate optimum operation. In conjunction with the adjustment of the sled, the cutting teeth may be adjustably positioned relative to the outer surface of the drum so as to compensate for length requirements.

The machine is controlled through an elongated handle which is pivotally coupled to the rear of the machine frame, preferably directly above a pair of caster wheels which facilitate maneuvering. As the handle is pushed down towards the surface of the roof, for example, the drum is pivoted over the caster wheels out of contact with the roof, and quick maneuvering of the machine is thus facilitated upon the caster wheels rather than upon the sled. In order to compensate for roofs of varying inclinations, the handle is pivoted at a user adjustable inclination relative to the frame.

For purposes of safety the the handle includes a kill switch which must always be depressed if the motor is to operate. During normal operation of the tool the user will manually grasp the handle bar with his hands, and a thumb or finger will maintain the kill switch in the "motor on" configuration. If the machine is either intentionally or inadvertently released, the kill switch will automatically turn off the motor to prevent possible injury or damage.

Preferably the front of the drum is shrouded by a protective guard pivotally associated with the front of the frame. The rotating drum is appropriately journalled between suitable bearings, and it is rotated by an appropriate pulley and belt system which has been shrouded to prevent injury to the operator.

Thus a broad object of the present invention is to provide a power operated shingle removal tool.

Another object of the present invention is to provide a motor powered shingle removing tool which forcibly removes shingles from roofs.

A related object of the present invention is to provide a shingle removing tool of the character described adapted to be employed upon roofs of varying inclinations.

A similar object of the present invention is to quickly and reliably remove roofing shingles of a variety of types and thicknesses.

Another object of the present invention is to provide a power operated shingle removing tool of the character described which automatically stops when the operator releases the handle, whether release was intentional or unintentional.

Yet another object of the present invention is to provide a reliable mechanical system which may be readily and easily maneuvered by an operator for quickly and safely removing roofing shingles.

Another object of the present invention is to provide a shingle removing tool of the character described which may be adjusted to fit a particular job application.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION OF THE DRAWINGS

Figure 1:
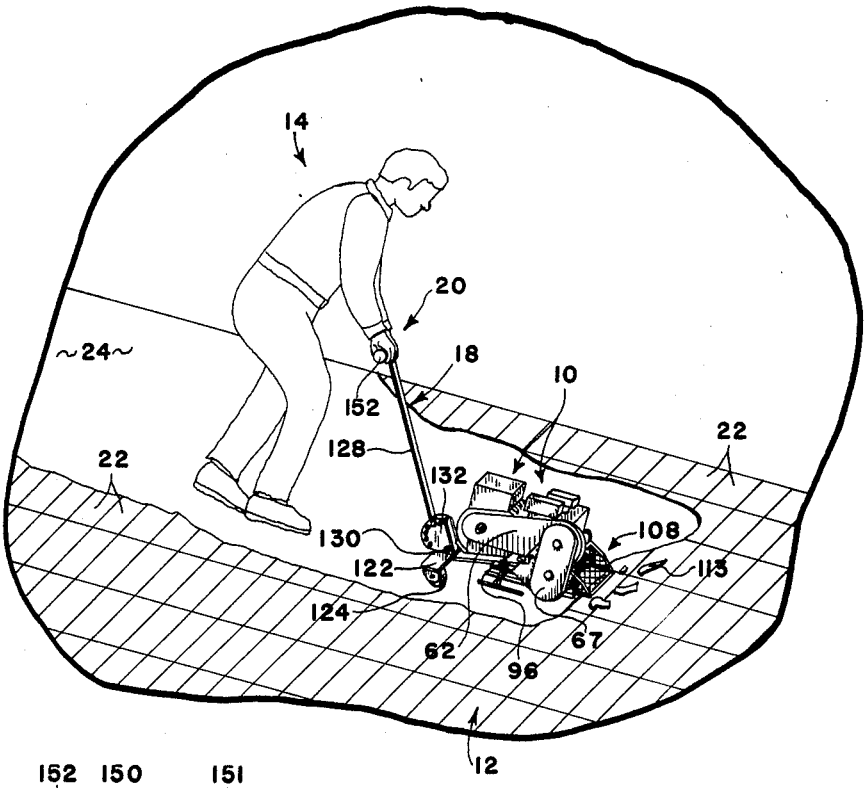
FIG. 1 is a fragmentary pictorial view illustrating use of the instant power tool upon a typical roof.

With preliminary reference now directed to FIG. 1 of the appended drawings, a power driven tool adapted to remove roofing shingles which has been constructed in accordance with the best mode teachings of the present invention has been generally designated by the reference numeral 10. Tool 10 is adapted to be operated upon a roof 12 by a workman 14 who grasps the tool handle 18 in his hands 20. Roof 12 is rather severely inclined, and it includes a plurality of conventional roofing shingles 22 which are to be removed by the tool 10 to yield a relatively clean surface 24 upon which new roofing will be applied.

Figure 2:
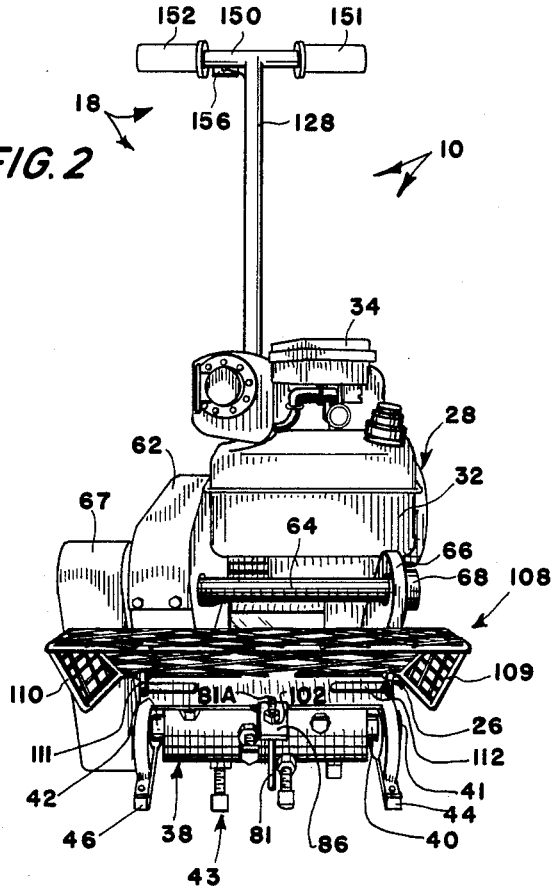
FIG. 2 is a front plan view of the invention.
Figure 3:
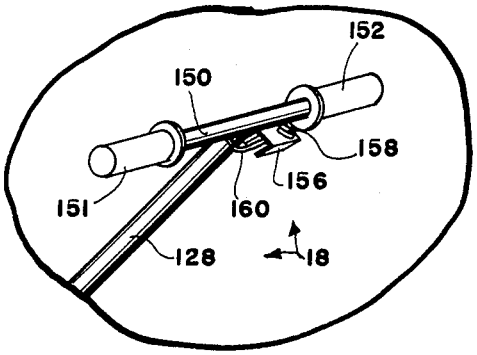
FIG. 3 is a fragmentary, isometric view of the preferred handle of the present invention.
Figure 4:
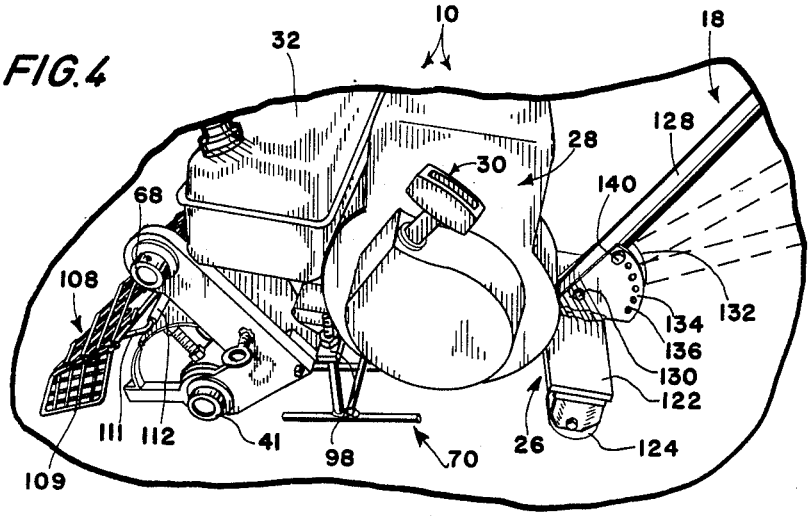
FIG. 4 is a fragmentary, oblique view of the instant power tool, with alternative positions of the handle indicated in dashed lines.

With additional reference now directed to FIGS. 2 through 7, tool 10 includes a rigid frame 26 adapted to support the conventional internal combustion motor, which has been generally designated by the reference numeral 28. Preferably, the internal combustion motor 28 comprises a five horsepower gasoline driven Briggs and Stratton engine of conventional design. It is secured midway upon the top of the frame 26, and as best illustrated in FIG. 4, it includes a conventional pull cord 30, a conventional gasoline tank 32, and a conventional air filter 34 (FIG. 2).

Figure 5:
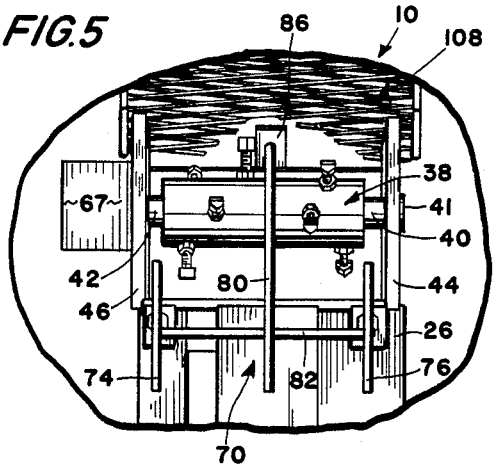
FIG. 5 is a fragmentary, bottom plan view of the tool.
Figure 6:
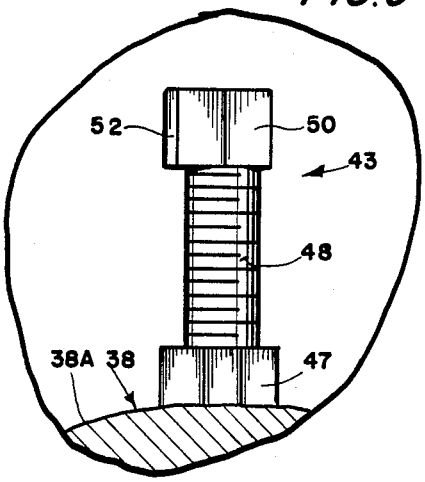
FIG. 6 is an enlarged, fragmentary, isometric view of a preferred drum tooth.
Figure 7:
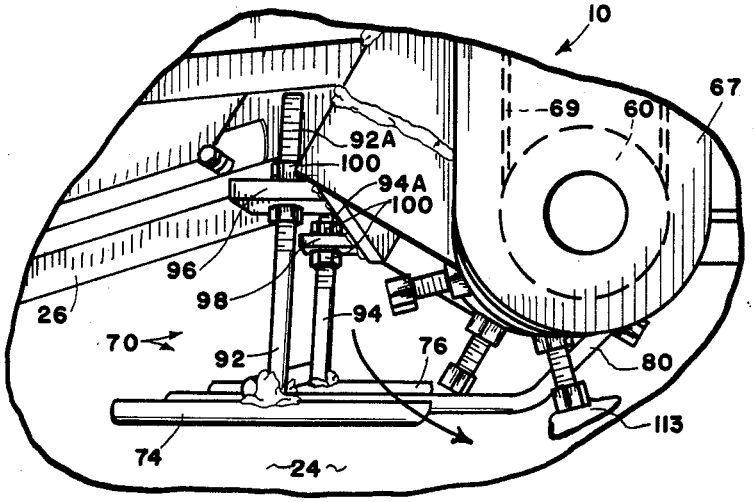
FIG. 7 is a fragmentary oblique view illustrating the side of the tool opposite from the side depicted in FIG. 4.

As best viewed in FIG. 5, tool 10 includes an elongated, generally cylindrical drum which has been designated by the reference numeral 38. Drum 38 includes a pair of axle members 40, 42 (FIG. 5) which are journalled for rotation in opposite sides 44, 46 of the frame 26. Drum 38 includes a plurality of teeth assemblies generally designated by the reference numeral 43. Each tooth assembly includes a stationary retaining bolt 47 welded upon the outer surface 38A of the drum, into which the shank 48 of the cutting tooth 43 is twistably secured. Teeth 43 may comprise conventional tool bolts and the heads 50 include a carbide edge 52 employed for forcibly contacting shingles 22 to be removed.

The drive shaft of the motor 28 is coupled through suitable pulleys to the drum 38 for rotating same. With reference to FIGS. 1 and 2, a suitable protective cage 62 shrouds the conventional internally disposed belt extending between the motor drive shaft and an idler shaft 64 (FIG. 2). Shaft 64 is journalled in frame side 66 through bearing 68, and it is splined to a pair of pulleys within shroud 62. Another belt 69 (FIG. 7) associated with conventional pulley 60 effectively couples axle 64 to axle member 42 of the drum within shroud 67.

Importantly, a rigid sled structure, generally designated by the reference numeral 70, elevates drum 38 above the shingles 22 to be removed at an appropriate operational distance. As best viewed in FIGS. 2, 5 and 7, sled 70 includes a pair of end rails 74, 76 which are parallel with and spaced-apart from a central rail 80. Rails 74, 76, and 80 are braced by a transverse portion 82 which is preferably welded thereto. The front portion 81 (FIG. 2) of the center sled rail 80 extends upwardly around the front of the drum 38 and terminates in a suitable bolt coupled to front frame tab 86 (FIGS. 2 and 5). Similarly, side rails 74 and 76 are threadably secured through vertical portions 92, 94 respectively to suitable frame tabs 96, 98. It will be appreciated that the threaded upper ends 92A, 94A of members 92 and 94 respectively are compressively held in place relative to tabs 96, 98 by pairs of suitable nuts 100, which compressively sandwich the frame mounting tabs 96 or 98 therebetween. These nuts 100 may be adjusted by the user to appropriately elevate the drum 38 above the shingles to be removed, in cooperation with adjustments to a similar pair of nuts 102 (FIG. 2) which position the uppermost threaded end 81A of the front 81 of the center rail 80 about frame tab 86.

A front mounted guard, generally designated by the reference numeral 108, has been pivotally associated with the front of the frame. Guard 108 (FIG. 2) is comprised of mesh steel, and its sides 109, 110 are pivotally coupled to the front of the frame through suitable angled prongs 111 received within appropriate mandrels 112 (FIG. 4). During normal operation the guard 108 will be allowed to extend generally horizontally forwardly from the apparatus 10 so as to prevent the inadvertent scattering of shingle particles 113 (FIG. 1) by the rapidly rotating drum 38. However, to permit drum maintenance or adjustment of the sled elevation as described previously, the protective guard 108 may be simply manually lifted to the position illustrated in FIG. 2. In the latter position, drum and tooth maintenance is facilitated.

The rear transverse frame member 122 is preferably equipped with a pair of downwardly projecting caster wheels 124 (FIG. 1, 4) which in operation help to support the tool frame and its associated components. This frame member 122 receives and mounts the tool handle, which has previously been generally designated by the reference numeral 18. Handle 18 includes an elongated rod portion 128 (FIG. 3) which is pivotally coupled to the frame by a suitable bolt 130 (FIG. 4) or the like which extends between a pair of rigid mounting plates 132, 134 which project upwardly from and which are welded to frame member 122. As will be appreciated from an inspection of FIG. 4, the outer radius of plates 132, 134 has been provided with a plurality of aligned orifices 136 which, when the handle inclination has been appropriately selected, will receive an appropriate bolt 140 to secure the handle apparatus 18 in the desired operative location.

The upper part of the handle 18 includes a transverse handle bar 150 rigidly attached thereto. Handle bar 150 includes a pair of spaced-apart conventional handle grips 151, 152 which may be grasped by the hands 20 of the user 14 for tool manipulation. A rigid angled mounting plate 156, secured to the handle bar 150 mounts a suitable kill switch 158 which communicates with the lower engine 28 through conventional wires 160. Switch 158 must be maintained in a depressed position by the user 14 for the motor 28 to operate. Thus by positioning the handle 18 as desired relative to orifices 136 (FIG. 4) the alternative handle orientations indicated generally by dashed lines in FIG. 4 may be selected. Of course, it is expected that the user 14 will select a desired handle elevation or orientation so as to maximize his comfort upon the roof 12 depending upon the steepness or inclination thereof. If user 14 drops or otherwise intentionally or unintentionally releases the tool, the motor, if it was running to begin with, will immediately shut off, so as to prevent inadvertent damage or injury.

From the foregoing, it will be seen that this invention is one well adapted to obtain all the ends and objects herein set forth, together with other advantages which are obvious and which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A power tool for removing roofing such as shingles or the like from roofs, the tool comprising:

rigid frame means adapted to be manually manipulated by a user of said tool during shingle removal, said frame means having a front, a rear, a bottom and sides;

drum means for forcibly removing said shingles, said drum means rotatably coupled to said frame means at the front thereof, the drum means comprising a rigid cylinder having an outer surface including a plurality of spaced apart teeth disposed about said outer surface and projecting outwardly therefrom for cutting shingles to be removed in response to drum rotation, wherein said drum means teeth may be selectively adjusted in length as desired by the user of said tool by screwing them inwardly or outwardly with respect to said drum means;

motor means supported by said frame means for selectively actuating said drum means;

sled means coupled to said frame means for supporting said frame means above said roof and for facilitating movement of said tool over said roof, said sled means comprising:

a pair of rigid, parallel, spaced apart end rails disposed in slidable roof-engaging contact generally horizontally upon opposite bottom sides of said frame means;

a rigid center rail having a portion thereof disposed between said end rails and an integral fromt portion thereof extending about the front of said frame means in front of and under said drum means to guard same; and, user adjustable vertical rail portions extending upwardly from said horizontal end rails and threadably adjustably coupled to said frame means, whereby the elevation of said drum means may be varied by selectively adjusting said sled means;

handle means operatively associated with the rear of said frame means for permitting manual manipulation of said tool by a user;

wheel means associated with said frame means rear for enabling the user to maneuver said tool substantially independently of said sled means; and, guard means pivotally associated with said frame means front for protectively covering said drum means during operation of said tool and for safely permitting concurrent visual inspection of said drum means.

2. A power tool for removing roofing such as shingles or the like from roofs, the tool comprising:

rigid frame means adapted to be manually manipulated by a user of said tool during shingle removal, said frame means having a front, a rear, a bottom and sides;

drum means for forcibly removing said shingles, said drum means rotatably coupled to said frame means at the front thereof, the drum means comprising a rigid cylinder having an outer surface including a plurality of spaced apart teeth disposed about said outer surface and projecting outwardly therefrom for cutting shingles to be removed in response to drum rotation, wherein said drum means teeth may be selectively adjusted in length as desired by the user of said tool by screwing them inwardly or outwardly with respect to said drum means;

motor means supported by said frame means for selectively actuating said drum means;

sled means coupled to said frame means for supporting said frame means above said roof and for facilitating movement of said tool over said roof, said sled means comprising:

a pair of rigid, parallel, spaced apart end rails disposed in slidable roof-engaging contact generally horizontally upon opposite bottom sides of said frame means;

a rigid center rail having a portion thereof disposed between said end rails and an integral front portion thereof extending about the front of said frame means in front of and under said drum means to guard same; and, user adjustable vertical rail portions extending upwardly from said horizontal end rails and threadably adjustably coupled to said frame means, whereby the elevation of said drum means may be varied by selectively adjusting said sled means;

handle means operatively associated with the rear of said frame means for permitting manual manipulation of said tool by a user, said handle means adapted to be selectively disposed at a selected one of a plurality of user-selectable angles relative to said frame means to adapt said tool for use upon roofs of different inclinations;

caster wheel means associated with said frame means rear for enabling the user to maneuver said tool substantially independently of said sled means by pushing down on said handle means to pivot the weight of said tool onto said caster wheel means; and, mesh guard means pivotally associated with said frame means front for protectively covering said drum means during operation of said tool and for safely permitting concurrent visual inspection of said drum means.

* * * * *